United States Patent [19]

Sweeney

[11] 4,354,855

[45] Oct. 19, 1982

[54] MOTOR FUEL

[75] Inventor: W. Alan Sweeney, Larkspur, Calif.

[73] Assignee: Chevron Research Company, San Francisco, Calif.

[21] Appl. No.: 155,029

[22] Filed: May 30, 1980

[51] Int. Cl.[3] ..... C10L 1/18

[52] U.S. Cl. ..... 44/56; 44/70; 44/77

[58] Field of Search ..... 44/56, 70, 77

[56] References Cited

U.S. PATENT DOCUMENTS 2,132,017 10/1938 Evans ..... 44/53

OTHER PUBLICATIONS

Carpino, "t-Butyl Cyanoformate and Iminodicarboxylate", May 15, 1964, pp. 2820–2824, pertinent page is 2822, J. Org. Chem. 29.

*Primary Examiner*—Winston A. Douglas
*Assistant Examiner*—Y. Harris-Smith
*Attorney, Agent, or Firm*—D. A. Newell; J. J. DeYoung

[57] ABSTRACT

Disclosed is a motor fuel comprising a major portion of gasoline-boiling-range compounds and from 0.1 to 49 volume percent t-butyl t-butoxyacetate.

5 Claims, No Drawings

MOTOR FUEL

BACKGROUND OF THE INVENTION

The present invention relates to a motor fuel composition comprising gasoline-boiling-range compounds and t-butyl t-butoxyacetate.

The use of oxygen-containing compounds in gasoline is known in the art. See for example U.S. Pat. Nos. 3,869,262 and 2,184,956. One problem with the use of oxygen-containing compounds in gasoline, particularly acetate compounds, is that they are generally harmful to automotive paint finishes. Thus, when small amounts of gasoline are spilled when filling a car, the paint tends to dissolve. For this reason many oxygen-containing compounds have been used in gasolines.

T-butyl t-butoxyacetate is a known compound, *J. Org. Chem.* 29, 2822 (1964).

SUMMARY OF THE INVENTION

A motor fuel comprising a major portion of gasoline boiling-range compounds and from 0.1 to 49 volume percent t-butyl t-butoxyacetate.

DETAILED DESCRIPTION OF THE INVENTION

The invention resides in a motor fuel comprising a major portion of gasoline-boiling-range compounds and 0.1 to 49 volume percent t-butyl t-butoxyacetate. The fuel will generally comprise 51 to 99.9 volume percent gasoline-boiling-range compounds (other than t-butyl t-butoxyacetate) and 0.1 to 40 volume percent t-butyl t-butoxyacetate. Preferably the fuel will comprise 90 to 99.8 volume percent gasoline-boiling-range compounds and 0.2 to 10 volume percent t-butyl t-butoxyacetate.

Gasoline-boiling-range compounds suitable for use in motor fuels are well known in the art and usually boil between about the boiling point of butane and 430° F. Generally, these compounds will comprise hydrocarbons derived from refined crude oil. However, oxygenated compounds can also be used, such as methanol, ethanol, methyl-t-butyl ether, etc.

Methods of making t-butyl t-butoxyacetate are known in the art. One method of making t-butyl t-butoxyacetate is by reacting glycolic acid with isobutene in the presence of an acid catalyst, such as sulfuric acid, p-toluene sulfonic acid, etc.

A motor fuel consisting of 92 volume percent of a lead-free standard gasoline having a research octane number of 95.3 and a motor octane number of 85 and 8 volume percent of various acetates were tested under standard test conditions (ASTM D-2699 and D-2700) to determine their research and motor octane numbers.

The blending octane number (ON) is calculated as follows:

$$\text{Blending } ON = \frac{100(\text{measured } ON \text{ of blend} - ON \text{ of base fuel})}{\text{percent substance in blend}} + ON \text{ of base fuel}$$

The same acetate compounds were also qualitatively tested for their attack on automotive paints by observing the effect on pencil paint. Several drops of the pure compound were placed on a pencil for about two minutes and then wiped off. The extent of any loss of gloss and removal of paint was observed. The results of the various tests are shown in Table I below.

TABLE I

| Ether Additive | Blending Research Octane No. | Blending Motor Octane No. | Paint Attack |
|---|---|---|---|
| None (base fuel) | 95.3 | 85 | slight, satisfactory |
| methyl t-butoxyacetate | 113 | 98 | severe, unsatisfactory |
| t-butyl methoxyacetate | 99 | 90 | moderate, unsatisfactory |
| t-butyl t-butoxyacetate | 113 | 96 | slight, satisfactory |

The above octane data indicates that t-butyl t-butoxyacetate has high blending research and motor octane numbers.

The above paint attack data further indicates that t-butyl t-butoxyacetate is unexpectedly superior to both the other acetate compounds.

What is claimed is:

1. A motor fuel comprising a major portion of gasoline-boiling-range compounds and from 0.1 to 49 volume percent t-butyl t-butoxyacetate, said motor fuel containing gasoline.

2. The motor fuel of claim 1 wherein 0.2 to 10 volume percent is t-butyl t-butoxyacetate.

3. The motor fuel of claim 1 wherein 51 to 99.9 volume percent of said fuel comprises gasoline-boiling-range compounds.

4. The motor fuel of claim 1 wherein 51 to 99.9 volume percent of said compounds comprises gasoline-boiling-range hydrocarbons.

5. The motor fuel of claim 1 wherein 90 to 99.8 volume percent of said compounds comprises gasoline-boiling-range hydrocarbons and 0.2 to 10 volume percent is t-butyl t-butoxyacetate.

* * * * *